US009368907B2

(12) United States Patent
Becker

(10) Patent No.: US 9,368,907 B2
(45) Date of Patent: Jun. 14, 2016

(54) CONNECTOR ASSEMBLY

(71) Applicant: Geospace Technologies Corporation, Houston, TX (US)

(72) Inventor: Timothy D. Becker, Cypress, TX (US)

(73) Assignee: Geospace Technologies Corporation, Houston, TX (US)

( * ) Notice: Subject to any disclaimer, the term of this patent is extended or adjusted under 35 U.S.C. 154(b) by 0 days.

(21) Appl. No.: 14/321,193

(22) Filed: Jul. 1, 2014

(65) Prior Publication Data

US 2016/0006165 A1 Jan. 7, 2016

(51) Int. Cl.

| | |
|---|---|
| ***H01R 13/52*** | (2006.01) |
| ***H01R 13/504*** | (2006.01) |
| *H01R 105/00* | (2006.01) |
| *H01R 13/623* | (2006.01) |

(52) U.S. Cl.

CPC ..... *H01R 13/5221* (2013.01); *H01R 13/504* (2013.01); *H01R 13/5202* (2013.01); *H01R 13/623* (2013.01); *H01R 2105/00* (2013.01)

(58) Field of Classification Search

CPC ..... H01R 13/5211; H01R 13/5202
USPC ..... 439/278, 281, 282, 271, 272, 273, 274, 439/275

See application file for complete search history.

(56) References Cited

U.S. PATENT DOCUMENTS

| | | | | |
|---|---|---|---|---|
| 3,601,524 A | | 8/1971 | Kauffman | |
| 5,120,268 A | * | 6/1992 | Gerrans | H01R 13/523 439/278 |
| 5,595,497 A | * | 1/1997 | Wood | H01R 13/523 439/282 |
| 5,641,307 A | | 6/1997 | Gerrans | |
| 5,878,001 A | * | 3/1999 | McNeel | G01V 1/181 181/122 |
| 5,984,724 A | * | 11/1999 | McNeel | H01R 13/405 439/281 |
| 6,162,082 A | * | 12/2000 | Karsten | H01R 13/625 439/318 |
| 7,033,193 B2 | | 4/2006 | Higgins et al. | |
| 7,150,098 B2 | | 12/2006 | Borgstrom et al. | |
| 7,195,505 B1 | | 3/2007 | Becker | |
| 8,323,053 B2 | | 12/2012 | Montena | |
| 2004/0018780 A1 | * | 1/2004 | Mott | H01R 13/04 439/722 |

OTHER PUBLICATIONS

International Search Report & Written Opinion (PCT/US2015/037212), dated Sep. 21, 2015.

* cited by examiner

*Primary Examiner* — Abdullah Riyami
*Assistant Examiner* — Harshad Patel
(74) *Attorney, Agent, or Firm* — Andrews Kurth LLP

(57) ABSTRACT

A male connector (20) for connection to a female connector (30) to form a water tight connector (40) is disclosed. A plug connector body (2) and a connector overmold (5) are connected together where the plug connector body (2) of hard urethane material is molded with no mold parting lines. The soft connector overmold (5) of soft urethane is fitted about a portion of the plug connector body (2) with heat applied such that the plug body (2) and overmold (5) are fused together along their connecting surfaces so that substantially no water ingress into the connection of plug body (2) and connector overmold (5) is possible. An "O" ring (14) is placed in an annular space (12) defined between facing shoulders of the connector overmold (5) and the plug connector body (2). Annular alignment keyways (16) of; the female connector (30) engage the "O" ring (14) to seal the male connector (20) and female connector (30) from water ingress.

15 Claims, 5 Drawing Sheets

CONNECTOR ASSEMBLY

BACKGROUND OF THE INVENTION

1. Field of the Invention

This invention relates generally to the field of electrical or fiber-optic connectors possessing moisture and water proof integrity. More specifically, this invention provides enhanced sealing ability of an "O" ring seal adjacent molded plastic parts of the connector.

2. Description of the Prior Art

The terms "male" and "female" designations for electrical connectors are not used consistently in the field. Some connectors are designated as "male" because their inserts are received into the shells of the mating connectors, regardless of whether their electrical contacts are sockets, pins (or blades, etc.), or a combination of sockets and pins. "Insert," as used herein, designates that part of the connector which holds the contacts in position and electrically insulates them from each other and from the shell. The insert need not be a separate removable component of a connector assembly, as is the case with many cylindrical connector assemblies, and it may include the portion of a bonded unitary connector which performs the same function. The "shell" designates the outside case or outer surface of the connector.

Other connectors (e.g. D-subminiature connectors) are designated as "male", because their pin contacts are received into the socket contacts of the mating connectors, regardless of the fact that the shells of the male connectors receive the inserts of the female connectors. Furthermore, a connector pair may be arranged with no shell overhang so that neither connector's shell receives the insert of the mating connector. Thus, "male" and "female" designations as used herein are assigned by preference of the inventor for differentiating between complementary connectors in a connector pair. The terms are not meant to be used in any limiting manner.

Other connector gender designations are also used in the electrical connector field, for example the terms "plug" and "receptacle." As colloquially used, the insert of a "plug" is received into the shell of a "receptacle." Both plugs and receptacles are known in the art to have pins, sockets or a combination of pins and sockets. However, the "plug" and "receptacle" terminology is also subject to alternative meanings. For instance, "plug" is also defined as a connector which is designed to terminate a free end of a cable or cord, and "receptacle" is defined as a connector which is fixed to a bulkhead, wall, chassis, or panel. In other words, the "plug" is the movable connector and the "receptacle" is the fixed connector, regardless of which insert is received into which shell or which connector has pin contacts, socket contacts, etc. Using the latter terminology, when two cables are joined, the "plug-style" connector is often referred to as a "plug" and the "cable-connecting-receptacle-style connector" is often referred to as a "cable connection plug." Notwithstanding the above definitions, as used herein, the term "plug" simply refers to that portion of a connector insert which is received into the shell of the other, and the term "receptacle" simply refers to that potion of a connector shell which receives the insert of the other.

When there is a requirement for joining electrical conductors or optical fibers that are to be deployed under water or in humid environments, it is preferable to use connectors that are constructed in such a manner as to offer ease of mating and waterproof integrity. An O-ring, gasket, or packing is typically used to seal the cable end of a connector when repairability or modifiability is a required feature. Alternatively, the connector may be potted, adhesively bonded, or overmolded to create a seal between the cable jacket and the connector if re-entry is not required. However, sealing the interface between two mated connectors has traditionally been limited to the use of gaskets or O-rings which are compressed so that they conform to adjacent surfaces, thereby creating a fluid-proof barrier or seal which can be repeatedly mated and unmated.

The common interface between two connectors is most often sealed by only one sealing element, which is compressively engaged to effect the seal. The sealing element may be a separate and discreet piece which makes up the connector, or it may be an integral part of a unitary molded connector. A connector pair having only one interface sealing element provides no sealing redundancy, so that a defective seal at the connector interface is likely to destroy the integrity of the connection.

A prior art connector pair is shown in FIG. 1 and described in U.S. Pat. No. 7,195,505. FIG. 1 shows a male connector which includes an insert which defines a cylindrical plug with an outer end surface and an outer side surface. The male connector includes one or more electrical or fiber optic contacts such as sockets or pins. The plug of the male connector is characterized by a first annular groove disposed about the outer side surface at a first longitudinal distance from the outer end surface and a first annular compliant sealing element protruding about the outer end surface such that the sealing element is farther from the outer end surface than the groove.

A female connector shown in FIG. 1 includes a shell which defines a receptacle with an inner end surface and an inner side surface. The female connector includes one or more electrical or fiber optic contacts which correspond to the male connector contact for mating purposes. The receptacle of the female connection is characterized by a second annular compliant sealing element protruding about the inner side surface approximately at the first longitudinal distance from the inner end surface and a second annular groove disposed about the inner side surface approximately at the second longitudinal distance from the inner end surface. In other words, the receptacle is arranged and designed to removably receive the plug such that the sealing element of the plug is received in the groove of the receptacle, and vice versa, thereby operably coupling the contacts with redundant seals.

A problem can exist in the sealing capability of the connector where the exterior cylinder surface of the surface of the plug interfaces with the interior cylindrical surface of the insert of the connector of FIG. 1, so that small moisture passages are formed in the connector. This phenomenon is especially a problem when the connector is subjected to high pressure water environments.

3. Identification of Objects of the Invention

A primary object of the invention is to provide a connector that is less likely to be subject to leakage under high pressure water conditions.

Another object of the invention is to provide a soft plastic overmold for a cable to be secured to a male connector where the overmold is designed to surround an insert which is formed of hard molded plastic that has no significant mold parting lines.

SUMMARY OF THE INVENTION

The invention concerns an electrical connector which includes a molded hard plastic insert and a soft overmold connector that are fabricated so that the overmold and insert are not subject to leakage.

BRIEF DESCRIPTION OF THE DRAWINGS

The invention is described in detail hereinafter on the basis of the embodiments represented in the accompanying figures, in which.

DESCRIPTION OF THE INVENTION

LISTING OF ELEMENTS WITH REFERENCE NUMBERS USED IN THE DESCRIPTION

Figure 1:
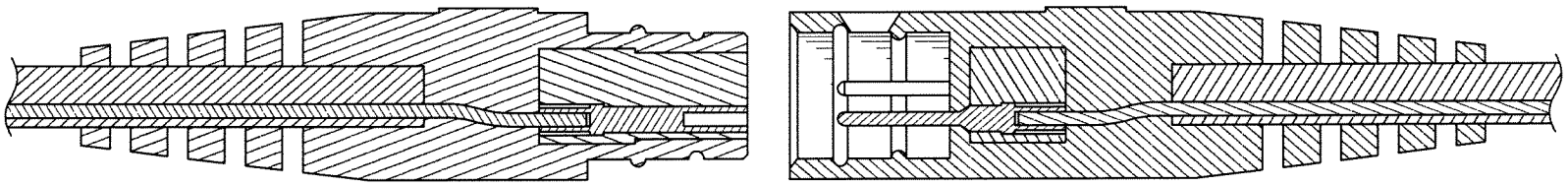
FIG. 1 (Prior Art)
FIG. 1 is a cross-sectional view of a prior art connector pair showing the male connector having one annular raised sealing element and one sealing element receiving groove and the female connector having one complementary sealing element receiving groove and one complementary annular sealing element.
Figure 3:
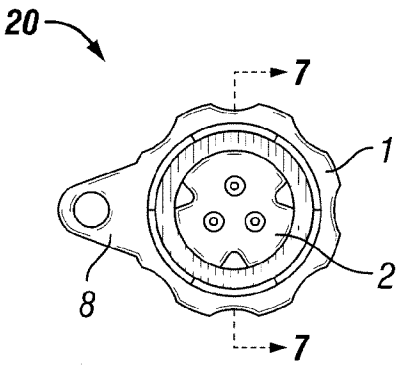
FIG. 3 is an end view of the male portion of the connector with section lines 7-7 of the male portion shown in the cross section view of FIG. 7.
Figure 5:
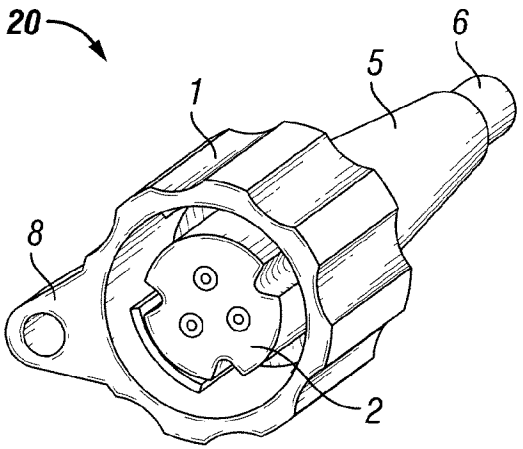
FIG. 5 is an elevation view of the front portion of the male connector.

1 coupling nut
2 plug connector body
4 shoulder
5 connector overmold
6 cable
7 connection pin
8 lock piece of coupling nut
9 lock piece of female portion
10 reference lines to surfaces between overmold and plug connector body
12 annular space
13 pin of female portion
14 "O" ring
16 alignment keyways
18 female portion
20 male connector
22 raised spiral connector of female portion
24 raised spiral connector of coupling nut
30 female connector
40 connection FIGS. 2, 3, 4 and 5 are elevation views of the male connector 20. A coupling nut 1 is positioned around the outside of the plug connector body 2 which is made of hard polyurethane. A connector overmold 5 acts as a bend restrictor, and is made of soft polyurethane. Overmold 5 is disposed about cable 6. Coupling nut 1 has a laterally extending lock piece 8 for tying the coupling nut 1 to a female coupling piece (see FIG. 11).

Figure 2:
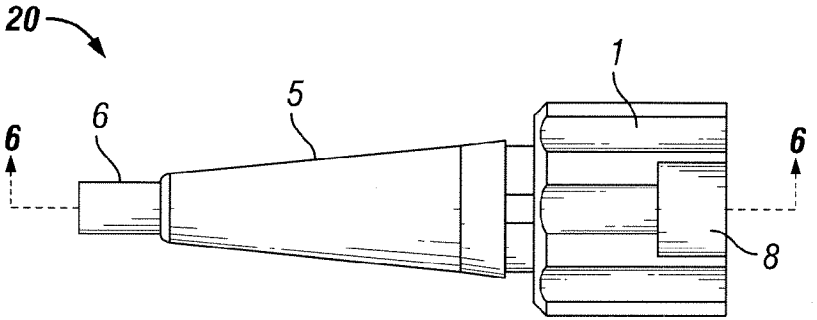
FIG. 2 is a side view of the male portion of the connection of the invention with section lines 6-6 of the male portion shown in the cross section view of FIG. 6.
Figure 4:
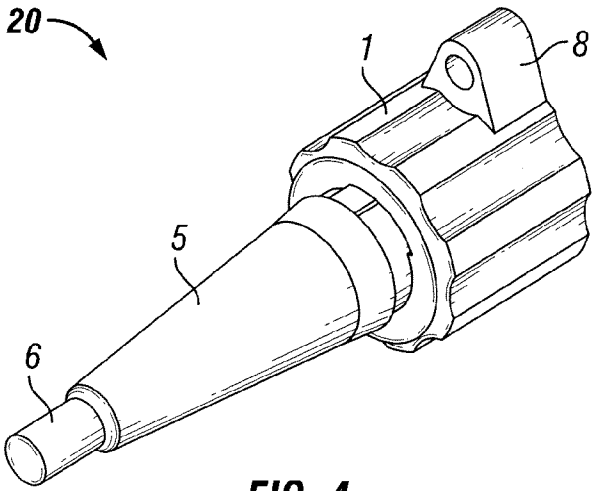
FIG. 4 is an elevation view from the rear of the male portion of the connector.
Figure 6:
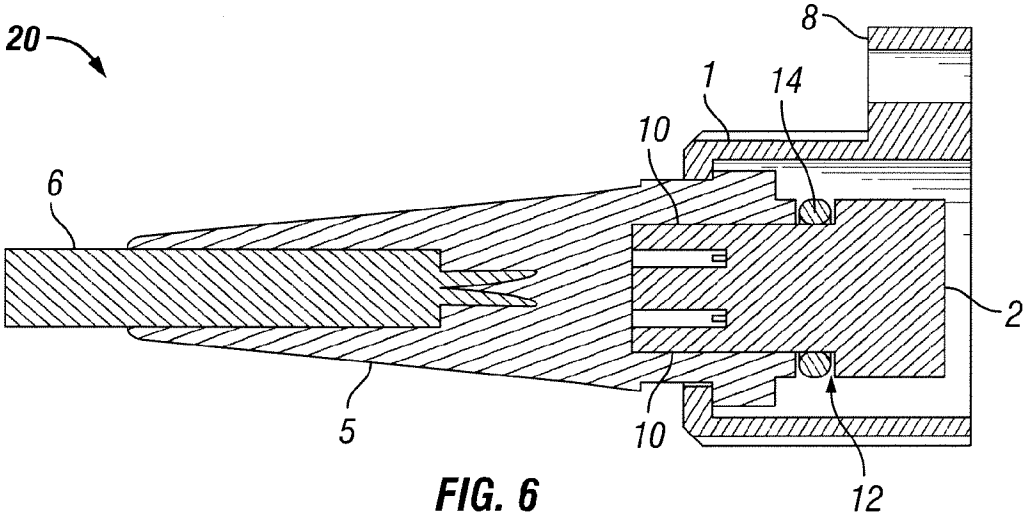
FIG. 6 is the cross section of the male connector viewed along lines 6-6 of FIG. 2.
Figure 7:
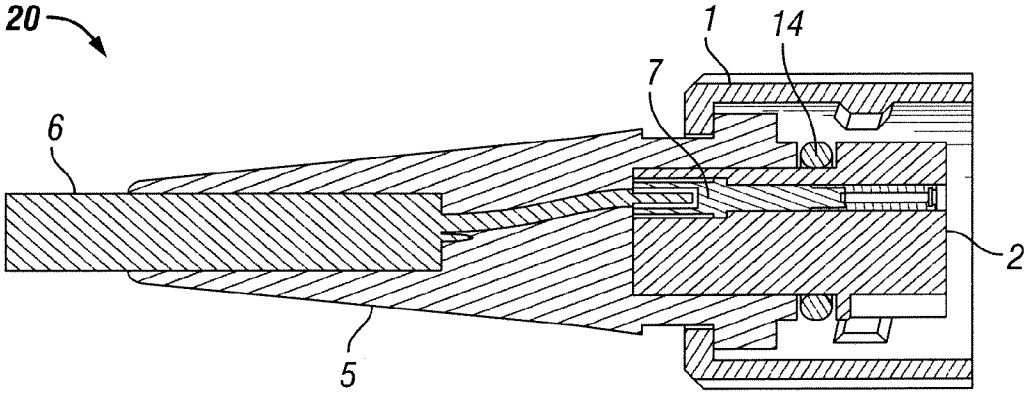
FIG. 7 is the cross section of the male connector viewed along lines 7-7 of FIG. 3.

FIG. 6 is a cross section view viewed from lines 6-6 of FIG. 2 of the male connector 20. FIG. 7 is a cross section of male connector 20 viewed along lines 7-7 of FIG. 3. Notice that FIG. 6 shows the lock piece 8 (see FIG. 2), but FIG. 7 looks 90° away from that of FIG. 6.

When the overmold piece 5 (made of soft polyurethane) is placed about cable 6 and the plug connector body 2 (made of hard polyurethane), it is essential that the surfaces, referred to by pointing reference lines 10, 10 of FIG. 6, bond together where they meet in order to maintain strength and protection from water ingress. Plug connector body 2, formed of polyurethane material is molded in such a manner as to have no chance of having a mold parting line. Because both the plug connector body 2 and overmold piece 5 are of polyurethane material, they have similar melt temperatures, even where the plug connector body 2 is of hard polyurethane and the connector overmold piece 5 is of soft polyurethane. When heated during connection to each other while being fabricated, a partial re-melt of the hard urethane of plug connector body 2 occurs causing a fusing of the materials along lines 10-10 of the connector overmold 5 and plug connector body 2.

Figure 9:
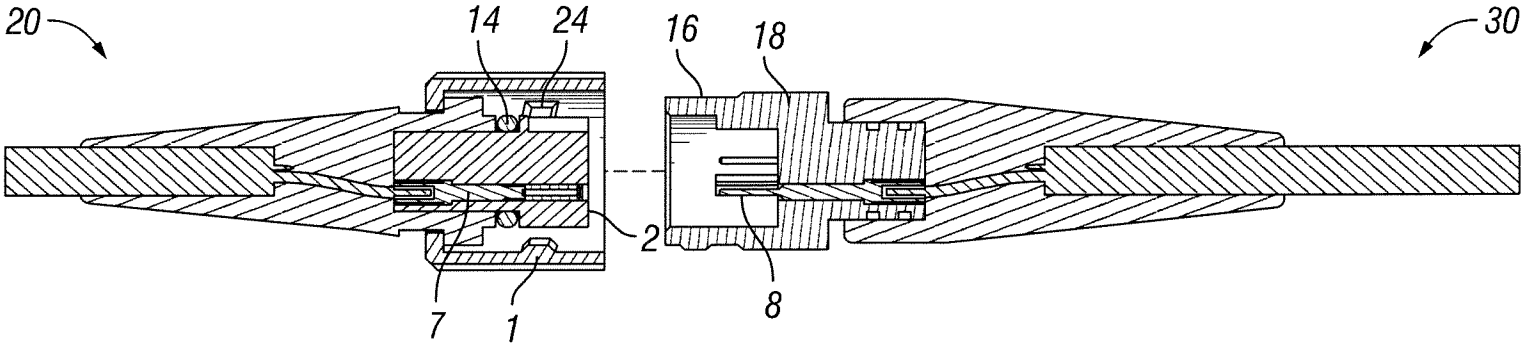
FIG. 9 in a cross section view of the male and female connector taken along lines 9-9 of FIG. 8.

As illustrated in FIGS. 6 and 7, the connector overmold 5 is cooperatively designed with male plug connector body 2 to provide an "O" ring groove, i.e., an annular space 12 in which an "0" ring 14 is placed. FIGS. 7 and 9 illustrate a connection pin 7 in plug connector body 2 which mates with a corresponding pin 13 of female portion 18. (See FIG. 12.) As illustrated below in FIGS. 11 and 12, alignment keyways 16 contact "0" ring 14, thereby providing a "seal" between the male plug connector body 2 and the female portion 18 to prevent water from entering the connection. The connection is especially adapted for water utility use. Accordingly, a water tight connection is essential for its intended use.

Figure 8:
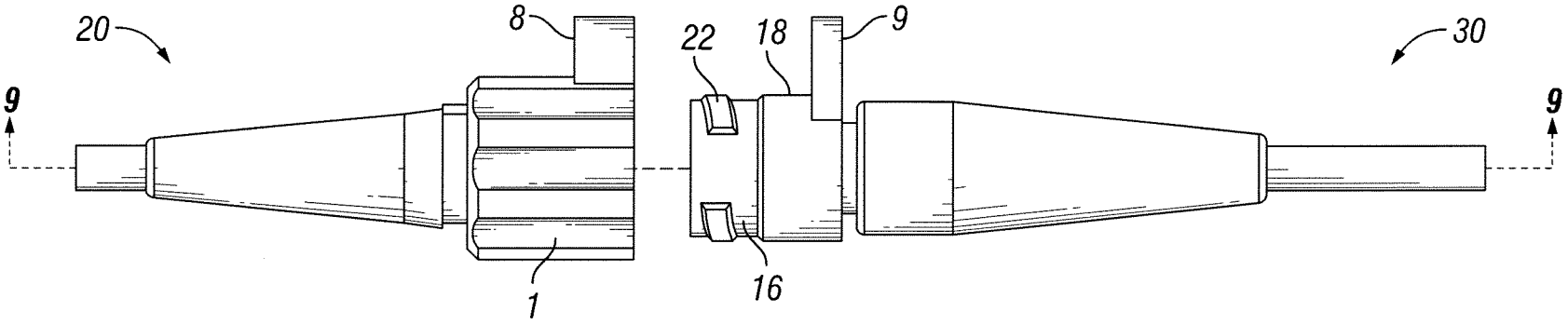
FIG. 8 in a side view of the male connector and the female connector prior to mating for connection.

FIG. 8 is an elevation view of the male connector 20 and female connector 30 lined up in an orientation prior to being plugged together. Lock piece 8 of the coupling nut 1 and lock piece 9 of female portion 30 are aligned ready for plug connection. FIGS. 8 and 9 illustrate external raised spiral connector 22 of female portion 30 and internal portion raised spiral connector 24 of the coupling nut 1 of the male connector 20.

Figure 10:
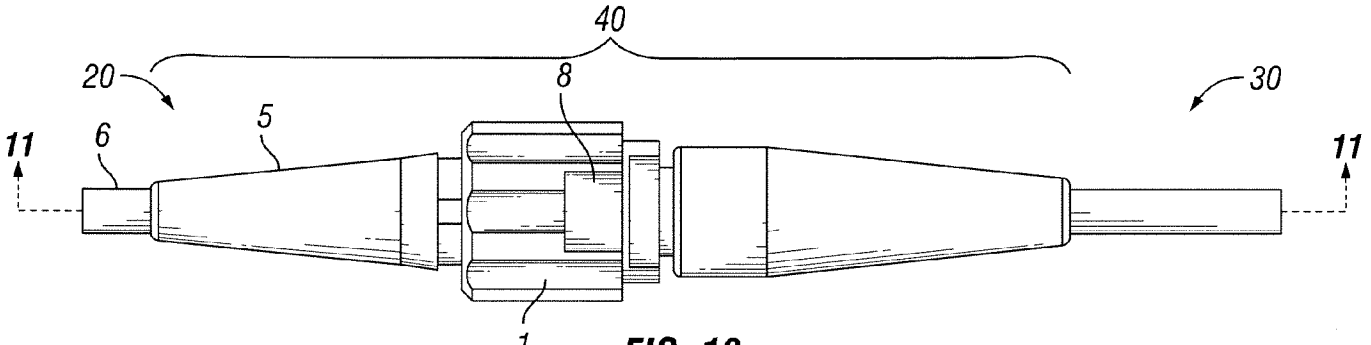
FIG. 10 is a side view of the male and female connectors while connected together to form a connection.
Figure 11:
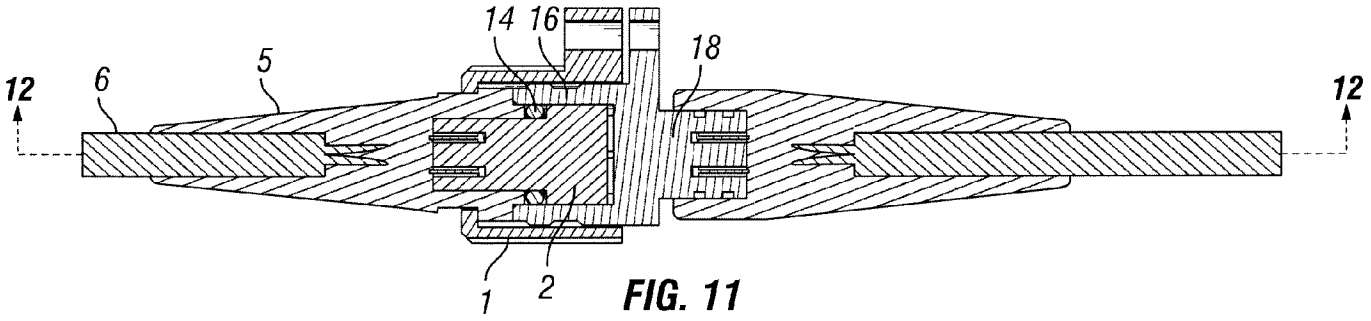
FIG. 11 is a cross sectional view taken along lines 11-11 of FIG. 10.
Figure 12:
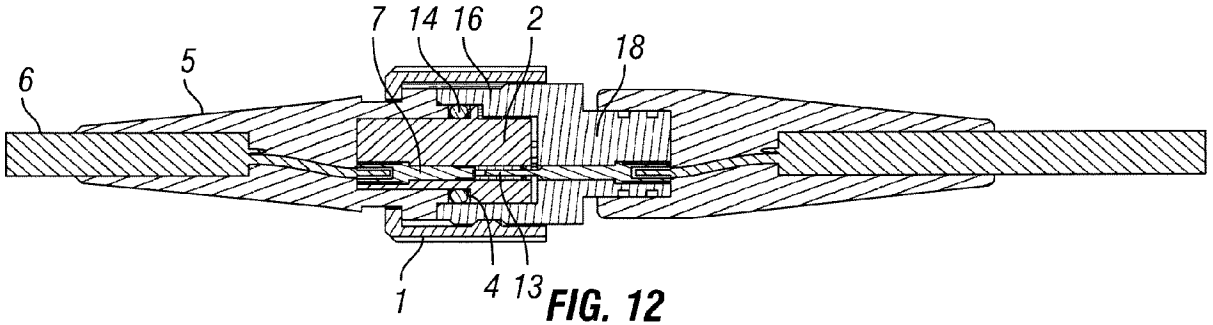
FIG. 12 in a cross-sectional view taken along lines 12-12 of FIG. 11.

FIGS. 10, 11 and 12 illustrate the connection with the male connector 20 and the female connector 30 made up together with FIG. 10 showing an elevation view of the made-up connection, FIG. 11 showing a cross-section view of the connection of FIG. 10 viewed along lines 11-11, and FIG. 12 showing a cross-section view of the connection taken along lines 12-12 of FIG. 11.

The FIGS. 11 and 12 show one of the three electrical plugs (see FIG. 7) mated together. FIGS. 11 and 12 illustrate an "O" ring 14 in the "O" ring groove defined between the longitudinal end of connector overmold 5 and a shoulder 4 of male plug connector body 2. The shoulder 4 is formed between portions of different radii of male plug connector body 2.

The "O" ring 14 is captured in the "O" ring annular space 12 (FIG. 6) when the male plug connector body 2 is inserted in the female portion 18 and alignment keyways 16 contact the exterior of the "O" ring 14.

The soft urethane connector overmold 5 is harder than the "O" ring 14 material, thereby providing support from deformation of one wall of the annular space 12. The overmold 5 hardness is of 90-95 shore A hardness. The "O" ring 14 is preferably no harder than 70 shore A hardness. The opposite wall in the plug connector body 2 of the annular space is made of a hard material greater than that of the overmold 5.

What is claimed is:

1. An arrangement including a male connector designed for connection to a female connector to form a water tight connection, the male connector having a plug connector body of hard urethane material and a connector overmold disposed about a cable and about a portion of a cylindrical exterior surface of the plug connector body, the overmold being of relatively soft urethane material, wherein the connector overmold and the plug connector body are heated during fabrication when fitted together such that a partial re-melt of the hard urethane material of the plug connector body fuses with the relatively soft urethane material of the connector overmold thereby providing strength of connection and protection from water leakage between the connector overmold and the plug connector body, and wherein the plug connector body is molded with no significant mold parting line prior to its partial fusing with the connector overmold during connection of the plug connector body and the connector overmold.

2. The arrangement of claim 1, wherein the plug connector body has a first cylindrical portion with the cylindrical exterior surface about which the connector overmold is placed and a second cylindrical portion, the first cylindrical portion defined by a smaller diameter than that of the second cylindrical portion with an annular shoulder defined between the first and second cylindrical portions, and an "O" ring groove defined between an end of the connector overmold and the shoulder of the plug connector body.

3. The arrangement of claim 2, further comprising an "O" ring received in the "O" ring groove.

4. The arrangement of claim 3, wherein the female connector includes a female portion, the female portion arranged and designed to connect with the plug connector body, and wherein when the plug connector body and the female portion are connected together, the "O" ring forms a seal between the plug connector body of the male connector and the female portion of the female connector to prevent water from entering the connection.

5. The arrangement of claim 1, wherein the female connector includes a female portion with an inner sealing area, and the male connector has a radially outward facing groove defined in part by a second portion of the cylindrical exterior surface of the plug connector body, and an "O" ring received in the radially outward facing groove, wherein when the plug connector body and the female portion are plugged together, the "O" ring is compressed between the inner sealing area of the female portion and the second portion of the cylindrical exterior surface of the plug connector body.

6. An arrangement including a male connector designed for connection to a female connector to form a water tight connection, the male connector comprising:

a molded plug connector body of hard urethane material, the plug connector body having an outwardly facing first cylindrical portion and an outwardly facing second portion, an annular shoulder defined between the outwardly facing first and second portions, the outwardly facing first cylindrical portion having no mold parting line;

a cable connected to and extending from the plug connector body; and a connector overmold disposed about the cable and about a portion of the outwardly facing first cylindrical portion of the plug connector body, the overmold of relatively soft urethane material, wherein the connector overmold and the plug connector body are fused together, and the plug connector body is molded with no significant mold parting line prior to its partial fusing with the connector overmold.

7. The arrangement of claim 6, wherein at least part of the outwardly facing first cylindrical portion of the plug connector body is fused with the connector overmold.

8. The arrangement of claim 7, wherein the fusion of the plug connector body with the connector overmold provides strength of connection and protection from water leakage between the connector overmold and the plug connector body.

9. The arrangement of claim 6, wherein the connector overmold includes an end proximate the annular shoulder of the plug connector body with an annular space defined between the overmold end and the annular shoulder.

10. The arrangement of claim 9, further comprising an "O" ring received in the annular space between the overmold end and the annular shoulder.

11. The arrangement of claim 10, wherein the annular shoulder has no mold parting line.

12. The arrangement of claim 10, wherein the female connector includes a female portion arranged and designed to receive at least a portion of the plug connector body during connection of the male connector to the female connector, and wherein during connection of the male connector to the female connector the "O" ring provides a water tight seal between the plug connector body and the female portion.

13. The arrangement of claim 12, wherein during connection of the male connector to the female connector the "O" ring is radially compressed between the female portion of the female connector and the outwardly facing first cylindrical portion of the plug connector body.

14. An arrangement including a male connector designed for connection to a female connector to form a water tight connection, the male connector comprising:

a molded plug connector body of hard urethane material, the plug connector body having a first cylindrical portion and a second cylindrical portion, the second cylindrical portion having a larger diameter than the first cylindrical portion, an annular shoulder defined between the first and second cylindrical portions;

a cable connected to and extending from the plug connector body;

a connector overmold disposed about the cable and about a portion of the first cylindrical portion of the plug connector body, the connector overmold having an end proximate the annular shoulder of the plug connector body with an annular space defined between the overmold end and the annular shoulder, wherein the connector overmold end, the annular shoulder and the first cylindrical portion of the plug connector body in the annular space define a seal ring groove, wherein the connector overmold is of relatively soft urethane material, and the connector overmold and the first cylindrical portion of the plug connector body are fused together, wherein the plug connector body is molded with no significant mold parting line on the first cylindrical portion prior to the partial fusing of the first cylindrical portion with the connector overmold during connection of the plug connector body and the connector overmold; and an "O" ring received in the seal ring groove and encircling and contacting the first cylindrical portion of the plug connector body.

15. The arrangement of claim 14, wherein the female connector includes a female portion arranged and designed to receive at least a portion of the plug connector body during connection of the male connector to the female connector, and wherein during connection of the male connector to the female connector the "O" ring is radially compressed between the female portion of the female connector and the first cylindrical portion of the plug connector body to provide a water tight seal between the plug connector body and the female portion.

* * * * *